US010845022B2

(12) United States Patent
Godbillon et al.

(10) Patent No.: US 10,845,022 B2
(45) Date of Patent: Nov. 24, 2020

(54) LIGHT-EMITTING MODULE FOR A MOTOR VEHICLE

(71) Applicant: VALEO VISION, Bobigny (FR)

(72) Inventors: Vincent Godbillon, Bobigny (FR); Franck Millon, Bobigny (FR); Jean-Didier Kinfack, Bobigny (FR); Lothar Seif, Bobigny (FR); Natacha Audy, Bobigny (FR); Lingxuan Zhu, Bobigny (FR); Patrice Collot, Bobigny (FR); Arnaud Abala, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 16/337,715

(22) PCT Filed: Sep. 27, 2017

(86) PCT No.: PCT/EP2017/074547
§ 371 (c)(1),
(2) Date: Mar. 28, 2019

(87) PCT Pub. No.: WO2018/060284
PCT Pub. Date: Apr. 5, 2018

(65) Prior Publication Data

US 2020/0041094 A1 Feb. 6, 2020

(30) Foreign Application Priority Data

Sep. 28, 2016 (FR) ..... 16 59222

(51) Int. Cl.
*F21S 43/19* (2018.01)
*F21S 43/14* (2018.01)
(Continued)

(52) U.S. Cl.
CPC ..... *F21S 43/14* (2018.01); *F21S 41/143* (2018.01); *F21S 41/153* (2018.01); *F21S 41/28* (2018.01);
(Continued)

(58) Field of Classification Search
CPC ..... F21S 41/143; F21S 41/145; F21S 41/147; F21S 41/148; F21S 41/151; F21S 41/153
(Continued)

(56) References Cited

U.S. PATENT DOCUMENTS 10,165,641 B2 * 12/2018 Godbillon ..... F21S 41/28
2003/0193815 A1 * 10/2003 Mishimagi ..... B60R 1/1207 362/522
(Continued)

FOREIGN PATENT DOCUMENTS

DE 100 20 099 A1 10/2001
DE 102 50 877 A1 5/2004
(Continued)

OTHER PUBLICATIONS

International Search Report dated Nov. 30, 2017 in PCT/EP2017/074547 filed Sep. 27, 2017.

*Primary Examiner* — Christopher M Raabe
(74) *Attorney, Agent, or Firm* — Oblon, McClelland, Maier & Neustadt, L.L.P.

(57) ABSTRACT

A light-emitting module for a motor vehicle. The light-emitting module includes a substrate including a curved main section, light-emitting elements arranged on a face of the substrate and configured to generate light rays, a curved screen arranged facing the face of the substrate and away from the face, an area of the screen being suitable for being illuminated by the light rays emitted by the light-emitting elements, the screen having scattering properties with respect to the light emitted by the light-emitting elements,
(Continued)

each light-emitting element being arranged on the substrate in a given zone, each light-emitting element furthermore being arranged to emit the corresponding light rays in a main emission direction that is angularly offset from a local direction that is normal to the substrate in the given zone.

23 Claims, 3 Drawing Sheets

(51) Int. Cl.

| | |
|---|---|
| ***F21S 41/20*** | (2018.01) |
| ***F21S 43/40*** | (2018.01) |
| ***F21S 43/30*** | (2018.01) |
| ***F21S 41/143*** | (2018.01) |
| ***F21S 41/153*** | (2018.01) |
| ***F21S 41/32*** | (2018.01) |
| ***F21S 43/20*** | (2018.01) |
| *F21Y 103/30* | (2016.01) |
| *F21Y 107/20* | (2016.01) |
| *F21Y 115/10* | (2016.01) |
| *F21Y 107/50* | (2016.01) |
| *F21W 102/30* | (2018.01) |
| *F21W 103/10* | (2018.01) |
| *F21W 103/35* | (2018.01) |
| *F21W 103/20* | (2018.01) |
| *F21W 103/40* | (2018.01) |
| *F21W 103/55* | (2018.01) |
| *F21W 103/15* | (2018.01) |
| *F21W 103/45* | (2018.01) |

(52) U.S. Cl.
CPC ..... *F21S 41/285* (2018.01); *F21S 41/321* (2018.01); *F21S 43/26* (2018.01); *F21S 43/30* (2018.01); *F21S 43/40* (2018.01); *F21W 2102/30* (2018.01); *F21W 2103/10* (2018.01); *F21W 2103/15* (2018.01); *F21W 2103/20* (2018.01); *F21W 2103/35* (2018.01); *F21W 2103/40* (2018.01); *F21W 2103/45* (2018.01); *F21W 2103/55* (2018.01); *F21Y 2103/30* (2016.08); *F21Y 2107/20* (2016.08); *F21Y 2107/50* (2016.08); *F21Y 2115/10* (2016.08)

(58) Field of Classification Search
USPC ..... 362/509
See application file for complete search history.

(56) References Cited

U.S. PATENT DOCUMENTS

| | | | | |
|---|---|---|---|---|
| 2005/0225994 | A1* | 10/2005 | Rodriguez Barros | B60Q 1/2665 362/494 |
| 2009/0073709 | A1* | 3/2009 | Yajima | B60Q 1/2665 362/494 |
| 2013/0329444 | A1* | 12/2013 | Oh | F21V 21/00 362/543 |
| 2013/0329445 | A1 | 12/2013 | Oh | |
| 2017/0113605 | A1* | 4/2017 | Daicho | F21S 43/00 |
| 2018/0092180 | A1* | 3/2018 | Godbillon | F21S 41/663 |

FOREIGN PATENT DOCUMENTS

| | | | |
|---|---|---|---|
| DE | 102 55 709 | A1 | 6/2004 |
| EP | 2 671 756 | A2 | 12/2013 |
| JP | 2000-100216 | A | 4/2000 |
| KR | 10-1629663 | B1 | 6/2016 |

* cited by examiner

LIGHT-EMITTING MODULE FOR A MOTOR VEHICLE

The field of the invention relates to light-emitting motor-vehicle devices, and in particular to lighting and/or signalling devices.

As known, many of these devices comprise a light-emitting module provided with a plurality of light-emitting elements forming the light-emitting core of the device.

In certain applications, in particular signalling devices intended to be arranged at the rear of a vehicle, the devices have a profile that is cambered, i.e. curved, so as to match the shape of the body in which they are accommodated.

Such a geometric configuration places many constraints on the design of the devices.

Specifically, in particular, irrespective of potential considerations with respect to the uniformity of the obtained light distribution, which must be such as to make it difficult or even impossible for an observer to distinguish therein the light produced by individual light-emitting elements, this type of device is subject to regulations that in particular require the device to produce a spatial light-intensity distribution that has minimum values in certain directions and/or that does not exceed maximum values in other directions.

However, it is not easy to obtain a device that is both curved and that has these properties.

One solution commonly employed to achieve this result consists in providing, for accommodation of the light-emitting elements, a substrate taking the form of a plurality of planar plates that are separate from one another and that are oriented in a chosen way, for example substantially orthogonally to one or more light-emission directions that regulations require to be privileged.

This solution itself has drawbacks, in particular in terms of compactness and complexity. Specifically, because of the curvature of the device, these plates must have a staircase-like relative arrangement, this meaning that the volume occupied is large and that many elements for connecting and fastening the plates must be present within the device.

In practice, this makes this solution costly, difficult to apply in certain cases or even unusable.

Thus, the invention aims to provide a light-emitting module and a light-emitting device not having these drawbacks.

To this end, the invention relates to a light-emitting module, in particular for a motor vehicle, the light-emitting module comprising:

- a substrate comprising a curved main section,
- light-emitting elements arranged on a face of the substrate and configured to generate light rays,
- a curved screen arranged facing said face of the substrate and away from said face, an area of the screen being suitable for being illuminated by the light rays emitted by the light-emitting elements, the screen having scattering properties with respect to the light emitted by the light-emitting elements,
- each light-emitting element being arranged on the substrate in a given zone, each light-emitting element furthermore being arranged to emit the corresponding light rays in a main emission direction that is angularly offset from a local direction that is normal to the substrate in said given zone.

According to one aspect of the invention, with respect to at least one subset of said light-emitting elements, the main emission direction of each light-emitting element of said subset is substantially parallel to a local plane that is tangential to that zone of the substrate which is associated with the light-emitting element in question.

According to one aspect of the invention, the main section of the substrate and the screen are substantially parallel.

According to one aspect of the invention, with respect to at least one subset of the light-emitting elements, the light-emitting elements of said subset are arranged along a longitudinal direction of the substrate, the distances separating two consecutive elements along said direction being substantially identical.

According to one aspect of the invention, the light-emitting elements are substantially at the same distance from the screen, the distance between two consecutive light-emitting elements being smaller than or equal to the distance separating the light-emitting elements from the screen.

According to one aspect of the invention, the illuminated area of the screen is uniform during operation of the light-emitting module.

According to one aspect of the invention, the screen and the substrate define therebetween a space extending from the screen to the substrate, said space comprising a gas and the light-emitting elements, said space being devoid of optical elements for deviating the light emitted by the light-emitting elements or elements for guiding the light emitted by the light-emitting elements other than said gas and said light-emitting elements.

According to one aspect of the invention, the light-emitting elements make contact with said gas.

According to one aspect of the invention, the substrate is made from a reinforced epoxy-resin composite and has a thickness comprised between 0.3 mm and 1.6 mm.

According to one aspect of the invention, the substrate comprises a plurality of tabs extending from the main section in a central region of the substrate, at least one subset of the light-emitting elements being arranged on said tabs.

According to one aspect of the invention, each tab is substantially planar.

According to one aspect of the invention, the face of the substrate bearing the light-emitting elements is suitable for reflecting at least some of the light emitted by the light-emitting elements that reaches it.

According to one aspect of the invention, the face of the substrate bearing the light-emitting elements is suitable for scattering at least some of the light emitted by the light-emitting elements that reaches it.

According to one aspect of the invention, at least two light-emitting elements are arranged side-by-side along the substrate, at least one of said two light-emitting elements being pivoted toward the other or away from the other, so that the respective main emission directions of the two light-emitting elements are coplanar and nonparallel.

According to one aspect of the invention, the light-emitting module furthermore comprises a shaping optic interposed between at least one light-emitting element and the screen, the shaping optic being configured to deviate at least some of the light emitted by said at least one light-emitting element.

According to one aspect of the invention, the screen is made from a material having scattering properties.

According to one aspect of the invention, the screen has a face comprising microstructures that are suitable for scattering the light emitted by the light-emitting elements.

According to one aspect of the invention, the light-emitting module furthermore comprises a control assembly suitable for controlling at least the turn-on and turn-off of the light-emitting elements.

Advantageously, the control assembly comprises a plurality of control modules that are respectively coupled to light-emitting elements. The control modules are for example arranged on the substrate on a face thereof opposite the face bearing the light-emitting elements.

The invention furthermore relates to a motor-vehicle lighting and/or signalling device, the lighting and/or signalling device comprising a light-emitting module such as defined above.

According to one aspect of the invention, the motor vehicle extends along an axis, the light-emitting module having a privileged direction of light emission that is substantially parallel to said axis of the motor vehicle and substantially horizontal.

According to one aspect of the invention, the motor vehicle extends along an axis, the outline of the main section of the substrate and the outline of the screen having substantially the same shape in projection on a plane orthogonal to said axis of the vehicle.

According to one aspect of the invention, the lighting and/or signalling device furthermore comprises a casing and a closing outer lens that interact with each other in order to define a cavity that receives all or some of the light-emitting module.

According to one aspect of the invention, the lighting and/or signalling device furthermore comprises an accommodating housing produced within the cavity and that accommodates all or some of the light-emitting module, the screen at least partially obturating said housing.

The invention will be better understood on reading the following detailed description, which is given merely by way of example and with reference to the appended figures, in which:

FIGS. 1*a* and 1*b* are schematic illustrations of a light-emitting device according to the invention;

Figure 1A:
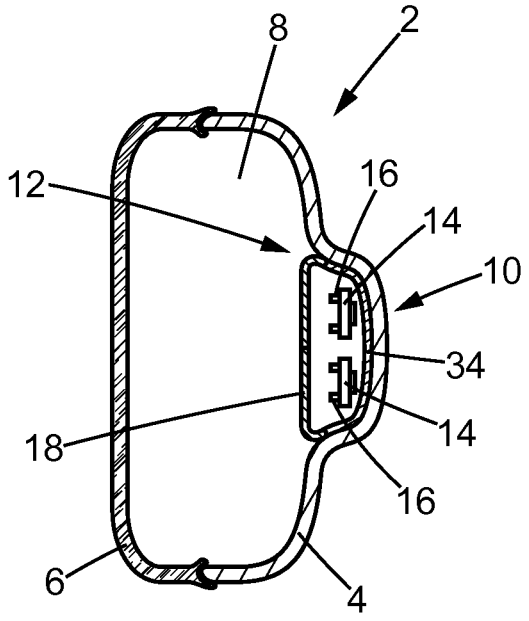
Figure 1B:
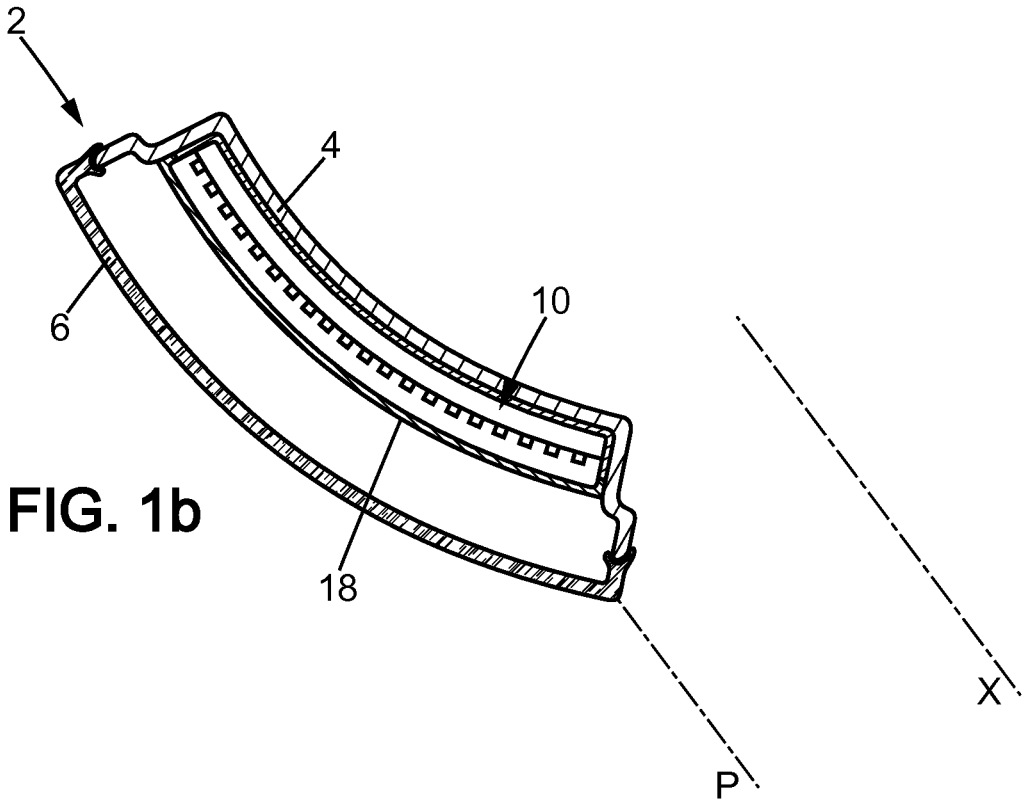

FIGS. 1*a* and 1*b* illustrate a light-emitting device 2 according to the invention, referred to simply as the device 2 below.

The device 2 is configured to emit light.

In the context of the invention, the device 2 is advantageously intended to be integrated into a motor vehicle. In other words, it is a light-emitting motor-vehicle device.

Advantageously, the device 2 is a lighting and/or signalling motor-vehicle device.

It is for example configured to perform one or more photometric functions.

A photometric function is for example a lighting and/or signalling function that is visible to the human eye. It will be noted that these photometric functions may be subject to one or more regulations establishing requirements in respect of colorimetry, intensity, spatial distribution on a so-called photometric chart, or even visibility ranges for the emitted light.

The device 2 is for example a lighting device and thus forms a vehicle headlamp—or headlight—intended to be arranged at the front of the vehicle. It is then configured to perform one or more photometric functions for example chosen from a low-beam function ("dipped beam"), a high-beam function ("full beam") and a fog-light function.

Alternatively or in parallel, the device is a signalling device intended to be arranged at the front or rear of the vehicle.

When it is intended to be arranged at the front, the photometric functions that it is configured to perform (optionally in addition to the one or more functions that it performs in its role as lighting device) include a direction-indicator function, a daytime-running-light (DRL) function, a luminous function intended to give the front of the vehicle a signature look, a position-light function, and a side-marker function.

When it is intended to be arranged at the back, these photometric functions include a reverse-light function, a brake-light function, a fog-light function, a direction-indicator function, a luminous function intended to give the back of the vehicle a signature look, a parking-light function, and a side-marker function.

Alternatively, the device 2 is provided to illuminate the passenger compartment of a vehicle and is then intended to emit light mainly into the passenger compartment of the vehicle.

Below, the device 2 is described nonlimitingly in a configuration in which it is intended to emit light toward the exterior of the vehicle and is a rear signalling device.

With reference to FIGS. 1*a* and 1*b*, the device 2 comprises a casing 4 and a closing outer lens 6, which interact with each other in order to define internally a cavity 8, and a light-emitting module 10 according to the invention, referred to simply as the module 10 below.

In the context of the invention, the device 2 is cambered, or curved. In other words, seen from above, the casing and the outer lens are curved, here in order to match the shape of the body of the vehicle in the region in which the device 2 is intended to be arranged. The left-most section of the device in FIG. 1*b* is for example intended to be arranged on the exterior side of the vehicle, the right-hand portion in contrast being oriented toward a median plane of the vehicle.

All or some of the module 10 is arranged in the cavity 8.

In certain embodiments, the device 2 comprises an accommodating housing 12 for accommodating the module 10. This housing is for example housed in the casing 4. As described below, this accommodating housing 12 is advantageously obturated toward the front by an element forming a screen for scattering the light generated by the module 10. The one or more internal faces of the housing 12 advantageously have reflective and scattering optical properties.

The module 10 is configured to emit light. Advantageously, as in the example of FIGS. 1*a* and 1*b*, it is arranged to emit light in the direction of the closing outer lens (which is transparent to at least some of the light emitted by the module 10).

In the context of the invention, the device 2 is configured to generate a spatial light-intensity distribution having, in at least a plurality of given directions, minimum and/or maximum values. In other words, in these directions, the light intensity emitted by the device 2 must be higher and/or lower than a preset threshold value. The threshold values are for example defined by one or more regulations. Such a direction P is illustrated in FIG. 1*b*, and it is for example a horizontal direction (in the sense of the orientation of the device 2 within the vehicle) parallel to an axis X of movement of the vehicle, along which the vehicle extends and along which the light intensity emitted by the device 2 must be higher than a given threshold value. This direction P may be considered to be a privileged emission direction (among a plurality of emission directions).

These intensity-distribution considerations place severe constraints on the module 10 in terms of the light intensity emitted in a given direction.

Figure 2:
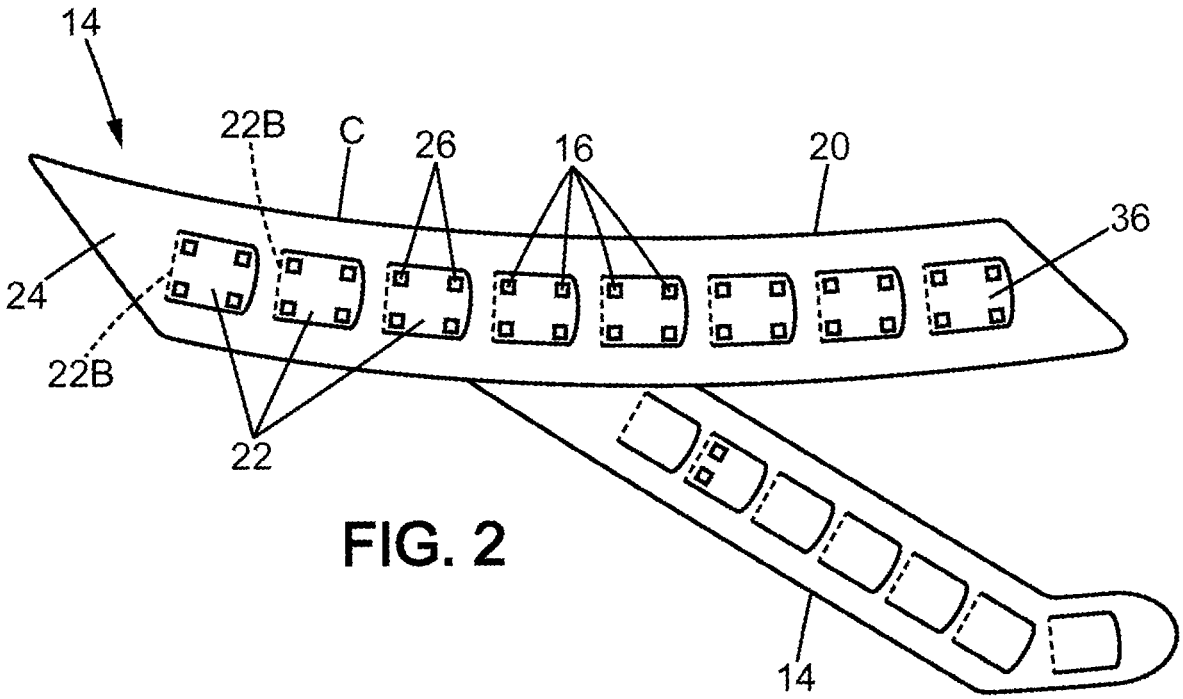
FIG. 2 illustrates a face-on view of one portion of a light-emitting module of the device of FIG. 1.

With reference to FIGS. 1*a*, 1*b* and 2, the module 10 comprises a substrate 14, light-emitting elements 16 and a screen 18.

The substrate 14 forms a carrier for the light-emitting elements 12.

Furthermore, the substrate is configured to convey electrical power to the light-emitting elements 12 with a view to the generation of light rays thereby. To this end, it comprises means for conveying electrical power that are configured to connect the elements 12 to an electrical power source. These means for example comprise connecting elements that are made of metal or metallized, such as wires or copper tracks.

The substrate 14 has a plate-like general shape. In other words, its thickness is small with respect to its other dimensions. It for example has a polygonal general shape, such as a rectangular general shape. Its corners are optionally rounded.

It will be noted in this respect that FIG. 2 illustrates two substrates 14 arranged in contact with each other. They may be considered to belong to separate modules 10 that the device 2 comprises. In this configuration, as described below, the respective screens 18 of the modules 10 are for example formed in the same part. As also illustrated in this figure, the substrate 14 may be arranged substantially horizontally with respect to the orientation of the vehicle (upper substrate), or indeed may be inclined with respect to the horizontal (lower substrate).

The substrate 14 has an outline C the edges of which may or may not be rectilinear. In practice, the shape of the outline C is advantageously chosen to correspond to the shape of the outline of the associated screen 18 in projection on a plane orthogonal to the axis X of the vehicle. Here, what is meant by this is that the outline of the substrate has the same general shape as that of the screen, but not necessarily the same dimensions. Furthermore, this is to be understood not to the exclude a rotation about an axis parallel to the axis X.

The substrate 14 comprises a main section 20 and tabs 22.

The main section 20 gives the substrate 14 its general appearance. It for example has a polygonal general shape, such as a rectangular general shape. For example, it is formed by the entirety of the substrate with the exception of the tabs 22 described below. However, in certain embodiments, the substrate may comprise regions other than the main section and the tabs, and that for example extend from the outside edge of the main section away from the main section. These regions are for example provided for accommodating connectors or for fastening the substrate to the rest of the device 2.

It will be noted that in this configuration, the outline C corresponds to the outline of the main section, if these extension regions are disregarded.

Advantageously, the main section 20 is supple. More specifically, it is able to deform elastically, in particular under the effect of a flexural stress, such as a flexion tending to bring its longitudinal ends closer to each other and applied normally to one face of the substrate.

This in particular allows the main section and the substrate generally to be curved, in particular with a view to arranging the main section of the substrate substantially parallel to the closing outer lens 6 and/or to the back wall of the casing 4 when the device 2 is curved.

The tabs 22 take the form of tongues of material. They extend from the main section. More specifically, they each extend from an internal edge of the main section. In other words, they do not extend from an external edge of the substrate 14, i.e. the edge of the substrate 14 turned toward the exterior.

These tabs are for example formed by cutting the substrate, which initially has an unapertured surface.

In practice, these tabs 22 are connected to the main section 20 via a connecting edge 22B (shown by a dashed line for some of the tabs in FIG. 2), and their other edges are free, i.e. separate from the substrate 14. The connecting edge 22B is for example integrally formed with the main section.

Advantageously, the tabs have a polygonal general shape, such as a rectangular general shape, all or some of the corners of which are optionally rounded. The connecting edge 22B corresponds to at least one side of this polygon, the other sides forming free edges.

Advantageously, they have substantially identical dimensions, at least as regards a subset thereof. It will be noted that for reasons of bulk or shape of the substrate, the end tabs may be required to have dimensions or even a shape that is different from those of the tabs that are not so near to the ends of the substrate.

The tabs 22 are substantially planar. Furthermore, advantageously, they are arranged to remain substantially planar in case of elastic bowing of the main section.

Figure 3:
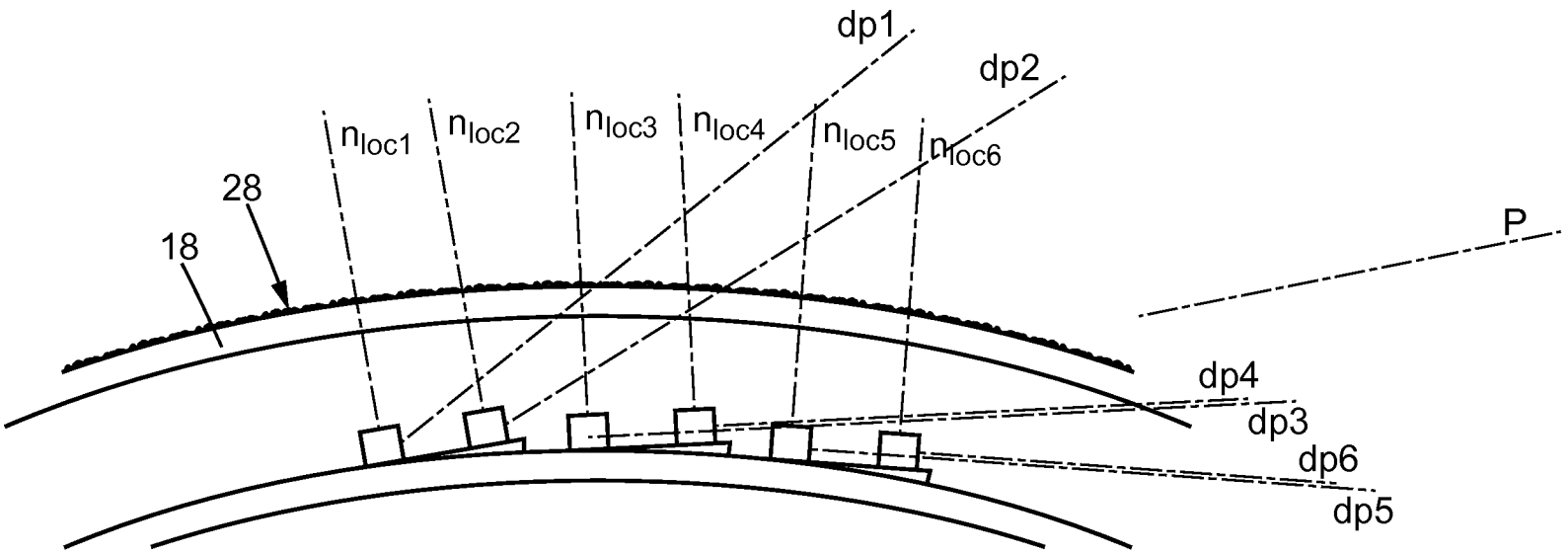
FIG. 3 illustrates a view from above of a light-emitting module according to the invention.

FIG. 3 illustrates the geometric configuration of the tabs in such a bowed configuration. In this configuration, the tabs lie substantially in a plane that is locally tangent to the main section.

The tabs are advantageously made from the same material as the rest of the substrate 14. Their planarity, in particular in the bowed configuration of the main section, has the effect of limiting the transmission of flexural stresses applied to the main section to the components arranged on the tabs and/or to the solder joints securely fastening said components to the surface of said tabs, and results in them maintaining their planar configuration even when the main section is bowed.

The substrate 14 for example comprises a plurality of tabs 22 arranged consecutively along the substrate. They are thus for example arranged aligned along a longitudinal direction of the substrate.

They for example have the same spatial orientation. For example, as illustrated in FIG. 2, the connection edge 22B of each of the tabs forms a proximal longitudinal end relative to one and the same end of the substrate, the opposite edge being turned toward the tab 22 that comes after in the direction of travel from this end to the other end of the substrate.

Preferably, the connection edge 22B of the tabs is substantially parallel to the axis of local curvature of the substrate. Thus, the tabs are only mechanically stressed a little or even not at all by the flexural stress on the substrate 14.

It will be noted that the substrate may comprise a row of tabs as illustrated in FIG. 2, or indeed a plurality of rows of tabs extending parallel to one another and offset from one another transversely to this longitudinal direction.

The substrate is for example made from a reinforced epoxy-resin composite, typically one reinforced with glass fibres. For example, it may be produced from the material commonly referred to as PCB FR-4 (PCB being the acronym of printed circuit board).

It advantageously has a thickness comprised between 0.3 mm and 1.6 mm. This configuration, combined with the presence of apertures (the outline of the tabs) in the surface of the substrate, makes it possible to promote the suppleness of the substrate and makes it possible to avoid costly materials commonly used to form flexible substrates.

As described below, the light-emitting elements are arranged on a given face 24 of the substrate. Advantageously, this face 24 is suitable for reflecting at least some of the light output by the elements 16 and that reaches it.

For example, to this end, this face is white.

Advantageously or in parallel, this face 24 is furthermore configured to scatter at least some of the light output by the elements 16 and that reaches it.

For example, to this end, it comprises suitable asperities.

It will be noted that the substrate is advantageously integrally formed from a given material, in contrast to a configuration made up of sections of different materials connected to one another and forming a heterogenous substrate. In other words, the main section extends from one end of the substrate to the other and is formed from a single section made from one given material, the tabs being integrally formed with this section.

The light-emitting elements 16 are each configured to emit light when they are suitably supplied with electrical power. These elements 16 form the light-emitting core of the module 10.

Advantageously, these elements 16 are semiconductor light-emitting element suitable for generating photons by electroluminescence. Advantageously, each element 16 of at least one subset of the elements 16 that the module 10 comprises is formed from a light-emitting diode. For example, they all are. The expression "formed from" is here understood to mean that the light-emitting structure that the element 16 comprises is a light-emitting diode, sometimes referred to as an LED chip.

In practice, in the context of the invention, at least one subset of the light-emitting element 16 comprises a diode and a package 26 within which the corresponding diode is arranged. The diodes themselves are sometimes referred to as LED chips, and form the light-emitting structure of the light-emitting element.

The arrangement of the diode within the package is chosen to obtain a corresponding main emission direction for the diode, which is chosen for a given orientation of the associated package 26. This main direction corresponds to the direction in which the element 16 in question emits a maximum light intensity.

The light-emitting elements 12 are arranged on the substrate. As indicated above, they are arranged on the same face 24 of the substrate. This face 24 is turned toward the screen 18 and the closing outer lens 6

To this end, the packages 26 are fastened to face 24.

In the context of the invention, the light-emitting elements are advantageously arranged on the tabs 22 of the substrate.

They are advantageously arranged in one or more rows. These rows are advantageously each parallel to a longitudinal direction of the substrate (which may be curved depending on the configuration in question of the substrate 14).

In the example of the figures, the elements 16 are thus arranged in two parallel rows.

Advantageously, the distance separating two consecutive elements 16 along the substrate is substantially constant.

Advantageously, with respect to at least one subset of the elements 16, each element 16 is associated with at least one element 16 located substantially in the same position along the substrate. In other words, the corresponding light-emitting elements are also arranged in columns each comprising at least two elements 16. Each column is advantageously substantially perpendicular to the longitudinal direction at least locally.

Advantageously, the distance separating two adjacent elements within a given column is substantially constant within the column, and preferably is the same for all the columns defined by the arrangement.

It will be noted that optionally the distance separating two consecutive elements within a row is the same as the distance separating two consecutive elements within a column.

The distance separating two consecutive elements 16 within a row and/or a column is for example comprised between the distance that separates the substrate from the screen, and 40% of this value.

In the context of the invention, with respect to at least one subset of the elements 16, the elements 16 are configured to have a main emission direction that is angularly offset from the direction normal to the substrate in the zone of the substrate bearing the element 16 in question. In other words, this direction does not correspond to the local normal to the substrate.

For example, the elements 16 are configured to emit light in a privileged main direction comprised angularly between a plane parallel to a local plane tangential to the corresponding zone of the substrate and the local normal to the substrate.

Advantageously, the corresponding elements 16 are configured to emit light in a privileged direction contained in a plane substantially parallel to the local plane tangential to the corresponding zone of the substrate. In other words, as illustrated in FIG. 3, the light-emitting elements are configured so that this direction is parallel to the tab 22 on which they are located.

The corresponding elements 16 are the type of light-emitting diode known as "side-emitting LEDs" or "side-LEDs".

In practice, the desired main direction is obtained by suitably arranging the diode within the corresponding package 26.

It will be noted that these configurations may be combined, the module 10 comprising elements 16 that emit parallel to the local plane tangential to the substrate in question and/or other elements that emit angularly between the plane parallel to the local tangential plane and the normal to the zone in question.

Furthermore, in addition to the light-emitting elements having a main emission direction such as above, the module 10 may comprise light-emitting elements the main direction of which corresponds substantially to the local normal to the substrate.

In FIG. 3, the main directions oriented parallel to the tangential local plane have been given the references dp3 to dp6 and the associated local normals the references $n_{loc3}$ to $n_{loc6}$. The main directions having a configuration that is simply inclined with respect to the corresponding other normal have been referenced dp1 and dp2 (the associated local normals have been referenced $n_{loc1}$ and $n_{loc2}$).

In certain configurations, the module 10 only comprises elements 16 having a main direction parallel to the local tangential plane.

Within a given column, for example for two consecutive light-emitting elements, the main directions are or are not substantially parallel to each other.

For example, for certain light-emitting elements, one or each of the two light-emitting elements is pivoted with respect to the other about an axis normal to the zone of the substrate bearing the element 16 in question. Thus, their main emission directions are substantially coplanar but not parallel.

In certain embodiments, they are pivoted toward each other so that their main directions (i.e. here the half-axis of origin the element 16 in question) intersect, as illustrated in FIG. 2 for the tab located furthest to the right. This for example makes it possible to compensate for the potential appearance of darker zones within the device in a region located between the two elements 16.

Alternatively, one or each is pivoted away from the other, as illustrated for the lower substrate.

For example, for this substrate, and generally, in particular for substrates oriented other than horizontally, one of the two light-emitting elements has a main emission direction that is aligned with the longitudinal direction of the substrate (optionally considered locally in the zone bearing the light-emitting element in question when the substrate does not extend in a rectilinear direction), and the other a horizontal main direction.

The module 10 is for example configured to emit light of white colour, or even red or amber colour. Other colours are also envisionable depending on the targeted application.

It will be noted that the module 10 may comprise elements 16 configured to emit light of white colour, others light of amber colour and/or others light of red colour.

The screen 18 is configured to form an illuminated area from the light emitted by the element 16. Furthermore, it is configured to scatter at least some of the light that is received from the light-emitting elements and that passes through it.

More specifically, conjointly with the substrate 14 and the light-emitting elements, the screen is configured to form a substantially uniform illuminated area. By uniform, what is meant is that the light-emitting elements are not distinguishable to the naked eye within this illuminated area by an observer the gaze of whom is directed toward the screen.

In practice, this property results—all else moreover being equal—from the combination of the density of distribution of the light-emitting elements over the substrate and the distance between these light-emitting elements and the screen.

Advantageously, to this end, with respect to at least one subset of the light-emitting elements and advantageously with respect to all thereof, the distance between two adjacent light-emitting elements is smaller than or equal to the distance that separates them from the screen, and advantageously smaller than 70% of the latter distance.

It will be noted that the uniformity may be quantified.

For example, denoting it H, it may be determined from or to be the lowest of a local uniformity L_U and an overall uniformity G_U.

The overall uniformity is for example given by the relationship:

$$\text{G_U} = 100 * \left(1 - \frac{\sigma(L_{ROI})}{Moy(L_{ROI})}\right)$$

where ROI is the illuminated area formed by the screen and $L_{ROI}$ is the luminance of the illuminated area (σ designating the standard deviation and Moy the mean)

The local uniformity is for example determined as follows. The following are considered: one pixel X of the illuminated area; the square region of side length n (for example n pixels) centred on X; and 8 adjacent square regions of side length n, these regions being respectively centred on pixels $X_i$ each located at a distance n from the point X. The points $X_i$ are for example regularly distributed about X.

The local contrast l_c as a function of n is defined by the relationship $$\text{l_c}(n) = \max_{\forall X \in ROI}\left(\max_{i=1,\ldots,8}\left(\frac{|M - Mi|}{|M + Mi|}\right)\right),$$

where M and M, are the mean luminances of the pixels of the regions centred on X and on the $X_i$ in question, respectively.

The quantity MSlocal_contrast is defined to be the highest of the local contrasts l_c(n) for n=2p+1, with p ranging from 1 to 20, and the quantity L_U is defined by the relationship L_U=100(1−2MSlocal_contrast).

It will be noted that in certain embodiments in which the device 2 comprises two relatively separate zones, the overall uniformity is for example the lowest of the respective uniformities of the two regions.

Furthermore, it may be a linear combination (or alternatively the lowest) of the uniformities in question along various axes.

Thus, in the context of the invention, the uniformity H is advantageously higher than 85%.

It will be noted that the screen 18 is at least partially transparent to the light of the elements 16.

A plurality of configurations are envisioned to obtain the scattering effect of the screen 18.

In a first configuration, the screen 18 is said to be scattering "in its bulk". In other words, it is produced from a scattering material. This type of material is sometimes said to be opalescent.

Alternatively, the screen has a surface provided with microstructures 28 intended to scatter the light of the light-emitting elements. The microstructures advantageously scatter the light by diffraction in transmission.

These microstructures 28 are for example produced in the surface of the external face of the screen, i.e. the face turned toward the closing outer lens. They are present on all of the surface of the screen (they are illustrated on only one portion of the screen 18 in FIG. 4 for the sake of a clarity).

Advantageously, the microstructures 28 are obtained by injection moulding.

These microstructures for example take the form of recesses or protrusions produced in the surface of the face of the screen. They have characteristic dimensions of an order of magnitude comprised between that of the wavelength of the light emitted by the light-emitting elements and one-hundred times this order of magnitude.

Advantageously, the microstructures have a scattering profile having a full width at half maximum, the opening angle at the apex of which is comprised between 25° and 80° in all the directions on either side of the normal to the screen, and even more preferably between 30° and 60°.

The screen 18 has a polygonal general shape, such as a rectangular general shape, its corners optionally being rounded.

The screen is arranged facing the face of the substrate 14 bearing the light-emitting elements 16. It is located away from this face and the light-emitting elements.

The screen is located at a distance from the substrate for example larger than 20 mm. This distance is for example comprised between 20 mm and 90 mm.

Advantageously, the screen 18 is curved. Preferably, it has a curvature identical to that of the substrate over at least some of its length. In other words, the screen, or more specifically the face thereof bearing the microstructures, is arranged substantially parallel to at least one portion of the main section of the substrate (i.e. of the large face thereof that is turned toward the screen). Thus, with respect to at least one subset of the elements 16, all of the light-emitting elements in question are all located substantially at the same distance from the screen 18.

Figure 4:
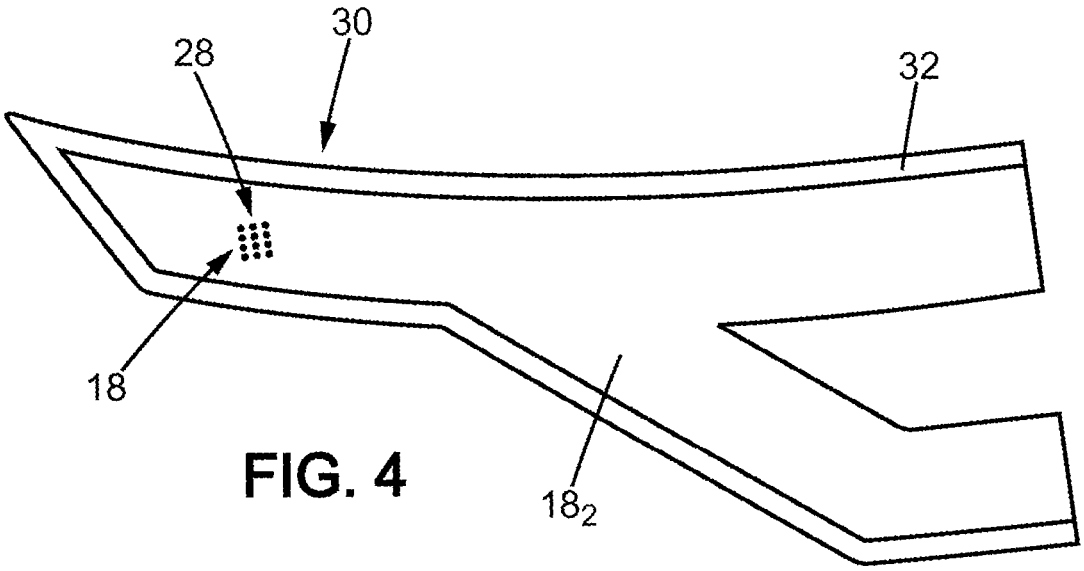
FIG. 4 is a schematic illustration of a scattering screen of a light-emitting module according to the invention.

It will be noted that optionally, as illustrated in FIG. 4, the screen 18 may be borne by a scattering element 30 belonging to the module 10. Apart from the screen 18, this element 30 comprises a fastening section 32 that encircles the screen over at least some of its perimeter. This section 32 is provided for fastening the element 30 within the volume 8, and optionally within the housing 12, and for handling the element 30.

It will be noted that the element 30 may comprise a plurality of screens, as illustrated in FIG. 4. In this figure, it comprises a substantially horizontal first screen and a second screen $\mathbf{18}_2$ of dog-legged shape extending from the first in a way that is inclined with respect to horizontal.

The screen is arranged within the device 2 so as to at least partially obturate the housing 12 toward the front.

As indicated above, the screen and the substrate have respective outlines the shapes of which are advantageously interdependent. Advantageously, the shape of the outline of the substrate corresponds to the shape of the outline of the screen in projection on a plane orthogonal to the axis X (although it is not excluded that the shapes be rotated with respect to each other or of different dimensions).

In this respect, in certain embodiments, the dimensions of the screen are larger than those of the substrate. In alternative configurations, the dimensions of the screen are smaller than those of the substrate.

Optionally, the element 30 is coupled to a jacket 34 with which it interacts or within which it is arranged, the jacket being arranged in the housing 12 or indeed defining the housing (for example by forming all or some of its wall). Conjointly to the element 30 or not, the jacket defines a closed volume in which the light-emitting elements and the substrate are arranged. This volume is configured so that the light of the light-emitting elements does not exit from the device 2 without having passed through the screen 18 beforehand.

Advantageously, the jacket has an internal face suitable for reflecting and/or scattering at least some of the incident light output by the elements 16.

For example, it is of white colour and/or has a surface metallization, and optionally has a scattering texture over all or some of this internal face.

Apart from the components described above, the module 10 advantageously comprises a control assembly 36 (FIG. 2) suitable for controlling at least the turn-on and the turn-off of the light-emitting elements. Advantageously, it is also configured to control the light intensity of the light emitted by the light-emitting elements.

The assembly 36 for example comprises a plurality of control modules that are respectively coupled to a plurality of light-emitting elements with a view to controlling the latter. These modules are for example distributed over the substrate, for example over the face of the substrate which is opposite to the face accommodating the elements 16.

Advantageously, the control assembly is configured to implement a lighting sequence in which all or some of the elements 16 are sequentially and/or all simultaneously turned on and/or turned off.

For example, this sequence is implemented in response to the detection of an event that occurs at the vehicle level, such as the start-up of the vehicle, the opening of a door that it comprises or indeed the actuation of a control for indicating a change in direction.

The operation of the device 2 will now be described with reference to the figures.

During the operation of the device, whether or not the light-emitting elements 16 are made to emit is controlled by the controlling assembly 36 via the electrical power conveyed via the substrate 14. In response, said light-emitting elements emit light with a maximum intensity in their main emission direction. This light is then scattered by the screen 18, after possible reflections from the jacket 34 and/or the face 24 of the substrate. The orientation of their respective emission directions makes it easier to meet requirements in terms of the spatial distribution of the light intensity of the device 2.

Optionally, at a given time, the control assembly 36 implements a lighting sequence, for example in response to an event detected at the vehicle level, or a malfunction of one or other of the light-emitting elements of the system.

The invention has a number of advantages.

Firstly, it makes it possible to obtain, with the device 2, a spatial light-intensity distribution within which certain directions normal to the screen do not by default form local intensity maxima, and to do so in a way that is simple. This is particularly advantageous when the device 2 has a curved configuration.

Furthermore, the presence of the tabs 22 ensures a good planarity at the interface of the light-emitting elements with the substrate and promotes the durability of the device 2 by minimizing stresses in fastenings of the light-emitting elements or even in the very structure of these elements.

Moreover, the light distribution obtained is uniform, i.e. the light-emitting elements are not discernible, or at least not easily discernible, as emitting units within the obtained light distribution.

In one particular embodiment, the module 10 comprises, apart from the above elements, at least one shaping optical element interposed between at least one light-emitting element and the screen. Each shaping optical element is configured to deviate at least some of the light of the corresponding light-emitting elements.

However, preferably, the volume defined between the substrate and the screen (and that extends from one to the other) is devoid of optical element other than the gas filling this volume and the elements 16. In other words, this volume is devoid of any element that emits light or deviates light other than the elements 16 themselves and this gas (which is for example air), such as for example optics for deviating or elements for guiding light. In particular, in these embodiments, the module 10 is devoid of primary optic associated with the elements 16, such an optic for example taking the form of a resin arranged in contact with the elements 16 and with the substrate and interposed between the screen and the substrate, or even of any optical element for deviating light, such as a lens or an intermediate screen between the screen 18 and the elements 16. In practice, the light-emitting elements make contact with this gas filling the volume between the screen and the substrate.

It will furthermore be noted that, preferably, the elements 16 are devoid of sub-component aiming to direct the maximum light intensity emitted by each thereof in a different direction from that in which they emit in the absence of such a component. For example, certain types of LEDs are known to include an optical lens mounted securely on the package thereof, components of this type having an impact on the optical behaviour of the element in question resulting in a deviation of the maximum light intensity emitted by the elements 16. Advantageously therefore, the elements 16 of the device 2 according to the invention are devoid of such components: specifically, for economic reasons, it is preferable to optimize the spatial distribution of the light intensities of the device by optimizing the arrangement of the elements 16 on the substrate, and the control of these elements 16, rather than expensively adding an optical device in or on the very structure of said elements 16.

It will however be noted that this does not exclude the presence of a protective material within the elements 16, and in particular within the package, this material for example taking the form of a layer deposited on the LED chip within the corresponding package. Such layers are for example made from epoxy or silicone resin.

The invention claimed is:

1. A light-emitting module for a motor vehicle, the light-emitting module comprising:

a substrate comprising a curved main section, light-emitting elements arranged on a face of the substrate and configured to generate light rays, a curved screen arranged facing said face of the substrate and arranged away from said face, an area of the screen being configured to be illuminated by the light rays emitted by the light-emitting elements, the screen having scattering properties with respect to the light emitted by the light-emitting elements, each light-emitting element being arranged on the substrate in a given zone, each light-emitting element furthermore being arranged to emit light rays in a single main emission direction that is angularly offset from a local direction that is normal to the substrate in said given zone, the main emission direction of each respective light-emitting element being substantially parallel to the main emission direction of an adjacent light-emitting element.

2. The light-emitting module according to claim 1, wherein, with respect to at least one subset of said light-emitting elements, the main emission direction of each light-emitting element of said subset is substantially parallel to a local plane that is tangential to a zone of the substrate which is associated with the light-emitting element in question.

3. The light-emitting module according to claim 1, wherein the main section of the substrate and the screen are substantially parallel.

4. The light-emitting module according to claim 1, wherein, with respect to at least one subset of the light-emitting elements, the light-emitting elements of said subset are arranged along a longitudinal direction of the substrate, distances separating two consecutive elements along said longitudinal direction being substantially identical.

5. The light-emitting module according to claim 1, wherein the light-emitting elements are substantially at a same distance from the screen, a distance between two consecutive light-emitting elements being smaller than or equal to a distance separating the light-emitting elements from the screen.

6. The light-emitting module according to claim 5, wherein the illuminated area of the screen is uniform during operation of the light-emitting module.

7. The light-emitting module according to claim 1, wherein the screen and the substrate define therebetween a space extending from the screen to the substrate, said space comprising a gas and the light-emitting elements, said space being devoid of optical elements for deviating the light emitted by the light-emitting elements and devoid of elements for guiding the light emitted by the light-emitting elements other than said gas and said light-emitting elements.

8. The light-emitting module according to claim 7, wherein the light-emitting elements make contact with said gas.

9. The light-emitting module according to claim 1, wherein the substrate is made from a reinforced epoxy-resin composite and has a thickness comprised between 0.3 mm and 1.6 mm.

10. The light-emitting module according to claim 1, wherein the substrate comprises a plurality of tabs extending from the main section in a central region of the substrate, at least one subset of the light-emitting elements being arranged on said tabs.

11. The light-emitting module according claim 10, wherein each tab is substantially planar.

12. The light-emitting module according to claim 1, wherein the face of the substrate bearing the light-emitting elements is suitable for reflecting at least some of the light emitted by the light-emitting elements.

13. The light-emitting module according to claim 1, wherein the face of the substrate bearing the light-emitting elements is suitable for scattering at least some of the light emitted by the light-emitting elements.

14. The light-emitting module according claim 1, wherein at least two of the light-emitting elements are arranged side-by-side along the substrate, at least one of said at least two light-emitting elements being pivoted toward another one of the at least two light-emitting elements or away from the another one of the at least two light-emitting elements, so that the respective main emission directions of the at least two two light-emitting elements are coplanar and nonparallel.

15. The light-emitting module according to claim 1, further comprising a shaping optic interposed between at least one light-emitting element and the screen, the shaping optic being configured to deviate at least some light emitted by said at least one light-emitting element.

16. The light-emitting module according claim 1, wherein the screen is made from a material having scattering properties.

17. The light-emitting module according to claim 1, wherein the screen has a face comprising microstructures that are suitable for scattering the light emitted by the light-emitting elements.

18. The light-emitting module according to claim 1, furthermore further comprising a control assembly suitable for controlling at least turn-on and turn-off of the light-emitting elements.

19. A motor vehicle lighting and/or signalling device, the lighting and/or signalling device comprising the light-emitting module according to claim 1.

20. The lighting and/or signalling device according to claim 19, the motor vehicle extending along an axis, the light-emitting module having a direction of light emission that is substantially parallel to said axis of the motor vehicle and substantially horizontal.

21. The lighting and/or signalling device according to claim 19, the motor vehicle extending along an axis, an outline of the main section of the substrate and an outline of the screen having a same shape in projection on a plane orthogonal to said axis of the motor vehicle.

22. The lighting and/or signalling device according to claim 19, further comprising a casing and a closing outer lens that interact with each other in order to define a cavity that houses all or some of the light-emitting module.

23. The lighting and/or signalling device according to claim 22, further comprising an accommodating housing produced within the cavity and that accommodates all or some of the light-emitting module, the screen at least partially obturating said housing.

* * * * *